US009574151B2

(12) United States Patent
Joseph et al.

(10) Patent No.: US 9,574,151 B2
(45) **Date of Patent: *Feb. 21, 2017**

(54) NANO-DISPERSIONS OF COAL IN WATER AS THE BASIS OF FUEL RELATED TECHNOLOGIES AND METHODS OF MAKING SAME

(71) Applicant: Blue Advanced Colloidal Fuels Corp., Panama (PA)

(72) Inventors: Daniel D. Joseph, Minneapolis, MN (US); Gustavo A. Nunez, Panama (PA); Maria Briceno, Panama (PA); Takeshi Asa, Osaka (JP); Cebers Gomez, Miranda (VE)

(73) Assignee: BLUE ADVANCED COLLOIDAL FUELS CORP., Panama (PA)

( * ) Notice: Subject to any disclaimer, the term of this patent is extended or adjusted under 35 U.S.C. 154(b) by 0 days.

This patent is subject to a terminal disclaimer.

(21) Appl. No.: 13/960,272

(22) Filed: Aug. 6, 2013

(65) Prior Publication Data

US 2014/0013656 A1 Jan. 16, 2014

Related U.S. Application Data

(60) Continuation of application No. 13/102,643, filed on May 6, 2011, now Pat. No. 8,500,827, which is a (Continued)

(51) Int. Cl.

| | |
|---|---|
| ***C10L 1/32*** | (2006.01) |
| ***C10L 1/10*** | (2006.01) |
| ***C10L 1/182*** | (2006.01) |

(52) U.S. Cl.

CPC ..... *C10L 1/326* (2013.01)

(58) Field of Classification Search

CPC ..... C10L 1/326

(Continued)

(56) References Cited

U.S. PATENT DOCUMENTS 3,718,585 A 2/1973 Lummus et al.
4,251,229 A * 2/1981 Naka et al. ..... 44/281

(Continued)

FOREIGN PATENT DOCUMENTS

EP 50412 A2 * 4/1982
GB 2303638 A 2/1997

(Continued)

OTHER PUBLICATIONS

Application and File History for U.S. Appl. No. 13/442,134, filed Apr. 9, 2012 inventors Núñez et al.

(Continued)

*Primary Examiner* — Pamela H Weiss
(74) *Attorney, Agent, or Firm* — Patterson Thuente Pedersen, P.A.

(57) ABSTRACT

Colloidal coal-in-water slurries having nano-particles of coal creating a pseudo-fluid. The colloidal coal-in-water slurry generally includes from about fifty to about seventy two weight percent of coal, with about 20 to about 80 percent of the coal having a particle size of about one micron or less with a mode particle size of about 250 nanometers. The coal-in-water slurry can also include a surfactant system containing one surfactant or mixtures of two or more surfactants, or mixtures of one or more surfactants and an inorganic or organic salt. The coal-in-water slurry can be used in low NOx burner applications as the main fuel and/or the reburn fuel, in gasification processes as the input fuel either alone, or in combination with organic materials, in gas turbine applications, and in diesel engine applications.

20 Claims, 12 Drawing Sheets

Related U.S. Application Data division of application No. 12/495,151, filed on Jun. 30, 2009, now Pat. No. 8,177,867.

(60) Provisional application No. 61/077,009, filed on Jun. 30, 2008, provisional application No. 61/157,089, filed on Mar. 3, 2009.

(58) Field of Classification Search
USPC ..... 44/503, 280, 500, 502, 501
See application file for complete search history.

(56) References Cited

U.S. PATENT DOCUMENTS

| | | | | |
|---|---|---|---|---|
| 4,331,447 | A | 5/1982 | Kamada et al. | |
| 4,477,259 | A * | 10/1984 | Funk | 44/280 |
| 4,488,881 | A * | 12/1984 | Mark | 44/280 |
| 4,599,089 | A | 7/1986 | Stigsson et al. | |
| 4,637,555 | A | 1/1987 | Furuichi et al. | |
| 4,650,496 | A | 3/1987 | Funk | |
| 4,722,740 | A | 2/1988 | Donnelly | |
| 4,734,103 | A | 3/1988 | Fong et al. | |
| 4,753,660 | A | 6/1988 | Kellerwessel et al. | |
| 4,756,720 | A | 7/1988 | Kikkawa | |
| 4,786,289 | A | 11/1988 | Shoji et al. | |
| 4,810,259 | A | 3/1989 | Rakitsky et al. | |
| 4,830,293 | A | 5/1989 | Furuichi et al. | |
| 4,834,549 | A | 5/1989 | Taniguchi et al. | |
| 4,957,511 | A | 9/1990 | Ljusberg-Wahren | |
| 5,042,990 | A | 8/1991 | Bonaccorsi et al. | |
| 5,114,598 | A | 5/1992 | Rayborn et al. | |
| 5,183,650 | A | 2/1993 | Goto et al. | |
| 5,379,902 | A | 1/1995 | Wen et al. | |
| 5,478,365 | A | 12/1995 | Nikanjam et al. | |
| 5,490,634 | A | 2/1996 | Jain et al. | |
| 5,582,484 | A | 12/1996 | Asa | |
| 5,599,356 | A | 2/1997 | Hashimoto et al. | |
| 5,690,704 | A | 11/1997 | Hayashi et al. | |
| 6,053,954 | A | 4/2000 | Anderson et al. | |
| 6,083,286 | A | 7/2000 | Ono | |
| 6,113,659 | A | 9/2000 | Logaraj et al. | |
| 6,132,478 | A | 10/2000 | Tsurui et al. | |
| 6,488,722 | B1 | 12/2002 | Ono | |
| 8,177,867 | B2 * | 5/2012 | Joseph et al. | 44/503 |
| 8,500,827 | B2 * | 8/2013 | Joseph et al. | 44/280 |
| 2002/0095867 | A1 | 7/2002 | Katayama | |
| 2006/0175230 | A1 | 8/2006 | Zhou et al. | |
| 2006/0186234 | A1 | 8/2006 | Kerns et al. | |
| 2007/0117737 | A1 | 5/2007 | Artiga Gonzalez et al. | |
| 2010/0024282 | A1 | 2/2010 | Joseph et al. | |
| 2011/0203163 | A1 | 8/2011 | Joseph et al. | |
| 2013/0074396 | A1 | 3/2013 | Núñez et al. | |
| 2014/0013656 | A1 | 1/2014 | Joseph et al. | |

FOREIGN PATENT DOCUMENTS

| | | | |
|---|---|---|---|
| JP | 54-111506 | A | 8/1979 |
| JP | 56-501568 | A | 10/1981 |
| JP | 57-096090 | A | 6/1982 |
| JP | 57-147595 | A | 9/1982 |
| JP | 02-251570 | A | 10/1990 |
| JP | 09-078075 | A | 3/1997 |
| JP | 09-169979 | A | 6/1997 |
| WO | WO 2007/012151 | A1 | 2/2007 |

OTHER PUBLICATIONS

PCT Search Report and Written Opinion dated Sep. 11, 2012 for PCT Application No. PCT/IB2012/000950 filed Apr. 6, 2012, 10 pages.

International Preliminary Report on Patentability dated Oct. 8, 2013 for PCT Application No. PCT/IB2012/000950 filed Apr. 6, 2012, 6 pages.

PCT Preliminary Report on Patentability and Written Opinion dated Jan. 5, 2011 for PCT Application No. PCT/US2009/049225 filed Jun. 30, 2009.

Núñez et al., "Colloidal coal in water suspension", Energy Environ. Sci., 2010, 3:629-640.

Ansolabehere et al., "The Future of Coal: Options for a Carbon-Constrained World", Massachusetts Institute of Technology, 2007, ISBN 978-0-615-14092-6.

Wibberley et al, "Efficient use of coal water fuels, CSIRO Energy Technology", Australian Government's Cooperative Research Centres Program, Pullenvale, 2008, Report 74.

Thambimuthu, "Developments in coal-liquid mixtures", Center for Applied Energy Research, University of Kentucky, Report 69, 1994.

Simeon, "Economical potential of coal-water mixtures", ICEASIE 8, IEA Coal Research, London, 1985, pp. 1-100.

Davis et al., "Evaluating the effects of low-$NO_x$ retrofits on carbon in ash levels," Proceedings of the Reaction Engineering International Mega Symposium: EPRI-DOE-EPA, Combined Utility Air Pollutant Control Symposium, Atlanta, 1999.

US Department of Energy, National Energy Technology Laboratory, "Micronized coal reburning demonstration for $NO_x$ control: a DOE assessment", Report DOE/NETL 2001/1148, 2001.

Boylu et al., "Effect of coal particle size distrubition, volume fraction and rank on the rheology of coal-water slurries", Fuel Processing Technology, 2004, 85:241-250.

Longlian et al, "A novel process for preparation of ultra-clean micronized coal by high pressure water jet comminution technique", Fuel, 2007, 86(5-6):750-757.

Boylu et al., "The effect of carboxymethyl cellulose (CMC) on the stability of coal-water slurries", Fuel, 2005, 84:315-319.

Dincer et al., "The effect of chemicals on the viscosity and stability of coal water slurries", Int. J. Miner. Process, 2003, 70:41-51.

Mishra et al., "Adsorption of sodium dodecyl benzenesulfonate onto coal", J. Colloid Interface Sci., 2003, 267:42-48.

Tiwari et al., "High-concentration coal-water slurry from Indian coals using newly developed additives", Fuel Process. Technol., 2003, 85:31-42.

Cheng et al., "Effects of pore fractal structures of ultrafine coal water slurries on rheological behaviors and combustion dynamics", Fuel, 2008, 87:2620-2627.

Ono, "Improved Coal Pulverization Method Using the Embrittlement due to Cracks Generated in Pores of Coal", Kona, 2003, 212(21):202-207.

Probstein, Physiochemical Hydrodynamics, Wiley Interscience, New York, 2nd edition, 1994, Chapter 9, pp. 277, 298-302.

Khodakov, "Coal-Water Suspensions in Power Engineering", Thermal Engineering, 2007, 54(1):36-47.

Cooper, "Direct Conversion of Coal and Coal-Derived Carbon in Fuel Cells", presented at The Washington Coal Club, Lawrence Livermore National Laboratory, Livermore, CA, 2004.

Sekar et al, "Diesel Engine Experiments with Oxygen Enrichment, Water Addition and Lower-Grade Fuel", Proceedings of the 25th Intersociety Energy Conversion Engineering Conference, 1990, 4(12-17):320-325.

Holt et al., "A Summary of Recent IGCC Studies of $CO_2$ Capture for Sequestration", Proceedings of MIT Sequestration Forum IV, Cambridge, Mass., 2003.

Turian et al., "Properties and rheology of coal-water mixtures using different coals", Fuel, 2002, 81:2019-2033.

Roh et al., "Rheological behavior of coal-water mixtures—1. Effects of coal type, loading and particle size", Fuel, 1995, 74(8):1220-1225.

Roh et al., "Rheological behavior of coal-water mixtures—2. Effect of surfactants and temperature", Fuel, 1995, 74(9):1313-1318.

Application and File History for U.S. Appl. No. 12/495,151, filed Jun. 30, 2009. Inventors: Daniel D. Joseph et al.

Application and File History for U.S. Appl. No. 13/102,643, filed May 6, 2011. Inventors: Daniel D. Joseph et al.

"Reburn Systems," GE Power Systems, © 2001 (2 pages).

EPA Site Technology Capsule, Texaco Gasification Process, Apr. 1995 (12 pages).

"Evaluating the Effects of Low-NOx Retrofits on Carbon in Ash Levels," Aug. 1999 (15 pages).

Lowe et al., "Moving Gasification Forward," GE Energy, 2004 (15 pages).

* cited by examiner

MICROPHOTOGRAPH OF REGULAR MILL

MICROPHOTOGRAPH OF NDT-SUPER COAL (PARTICLES ARE SO SMALL THEY FORM AGGREGATES IN THE DILUTED SLIDE SAMPLE)

NOx reduction (%) at 400 ppm initial NOx and 590 ms residence time.

NOx reduction (%) at 400 ppm initial NOx and 240 ms residence time.

NOx reduction (%) at 250 ppm initial NOx and 250 ms residence time.

NOx reduction as a function of initial NOx concentration at 240 ms residence time.

NOx reduction as a function of reburn zone residence time at 400 ppm initial NOx.

Comparison of slurry reburn performance vs. other fuels

Comparison of Loss on Ignition (LOI).

NANO-DISPERSIONS OF COAL IN WATER AS THE BASIS OF FUEL RELATED TECHNOLOGIES AND METHODS OF MAKING SAME

RELATED APPLICATIONS

This application is a continuation of application Ser. No. 13/102,643 entitled "Nano-Dispersions of Coal in Water as the Basis of Fuel Related Technologies and Methods of Making Same, filed May 6, 2011, which is a divisional of application Ser. No. 12/495,151 entitled "Nano-Dispersions of Coal in Water as the Basis of Fuel Related Technologies and Methods of Making Same," filed Jun. 30, 2009, now U.S. Pat. No. 8,177,867 issued May 15, 2012, which claims the benefit of U.S. Provisional Application No. 61/077,009 entitled "Nano-Dispersions of Coal in Water for use as a Fuel and Methods of Making Same," filed Jun. 30, 2008, and U.S. Provisional Application No. 61/157,089 entitled "Nano-Dispersions of Coal in Water for use as a Fuel and Methods of Making Same," filed Mar. 3, 2009, each of which are incorporated herein by reference in their entirety.

FIELD OF THE INVENTION

The present invention relates generally to a nano-dispersion of coal in water that is essentially a pseudo-fluid, and optionally other additives. The present invention also relates to the methods of making the nano-dispersion of coal in water, which can be used in several applications such as a fuel in boilers, secondary fuel for re-burning applications, as a feed for gasification and Oxycoal units, coal cleaning processes, diesel engines, gas turbines and fuel cells. The nano-dispersion of coal in water can also contain another water-soluble fuel such as methanol, ethanol, propanol, butanol and glycerol. An organic immiscible phase, such as spent oil engine or lube oil, hydrocarbons as heavy crude oils and bitumen, diesel, biodiesel, petroleum coke and/or biomass, can also be incorporated into the water in the form of nanodroplets or nanoparticles that enhance coal heat of combustion.

BACKGROUND OF THE INVENTION

Coal comprises a mixture of hydrocarbons and carbohydrates, with small amounts of nitrogen, sulfur, water, and minerals. Coal burns in air with a yellow, smoky flame, leaving ash behind. The energy content of coal depends upon its type. The heat of combustion of brown coal or lignite, for example, is about twenty-five kJ/g, and the heat of combustion of bituminous coal and anthracite is about thirty-two kJ/g. When coal burns, it mainly produces water and carbon dioxide, however it also produces harmful sulfur dioxide, carbon monoxide, hydrocarbons, particulate matter and soot, and oxides of nitrogen (hereinafter "NOx").

Boilers are closed vessels in which water or other fluids are heated. The heated or vaporized fluids exit the boiler for use in various processes or heating applications. In particular, utility boilers, which are typical drum-type boilers, are widely used in power plants, oil refineries, and petrochemical plants for steam generation to drive large turbines, producing electricity. In many instances, these boilers are coal-fired using coal at the burner to produce heated gases used to heat water, thereby generating steam.

Coal is also the cheapest and most abundant fuel on the world. As a consequence, any technology that allows the use of coal in a cleaner way is necessarily very attractive. Clean coal technologies require, among other things, more reactive coal in order to reduce or eliminate particulate matter and soot, carbon monoxide, hydrocarbons and NOx's emissions. More reactive coal implies complete combustion of coal particles and improved access to reactants or adsorbants to coal surface.

One study that was conducted by Davis et al., uses advanced calculations demonstrating that only coal particle sized below eighteen microns, will burn completely inside a 900 MW tangentially fired boiler retrofitted with low NOx burners (Davis et al., "Evaluating the Effects of Low-NOx Retrofits on Caron in Ash Level", Reaction Engineering International; Presented at the Mega Symposium: EPRI-DOE-EPA Combined Utility Air Pollutant Control Symposium in Atlanta, Ga., August, 1999). It is important to note, however, that currently commercial pulverized coal is typically ground to sixty micrometer average diameter. Further, commercial micronized coal has about fifteen microns average particle size, which means that a significant portion of the particles sizes are above the eighteen micron size, therefore contributing to the carbon in ash content. The Davis et al. study in view of the present invention is incorporated herein by reference.

Decreasing coal particle size implies increasing specific surface area, thereby increasing reactivity. Reducing particle size and obtaining a more reactive coal, opens many other applications, namely, as a feedstock for conventional but less polluting boilers; as a reburn fuel to reduce NOx emissions; as a feedstock of gasification and Oxycoal units; and as a feed in diesel and gas turbines. Further, coal cleaning processes are greatly enhanced by increasing specific surface area, facilitating the extraction of polluting minerals and solid compounds. Hereafter follows a description of these applications and the way they would benefit by using a micronized coal.

Boilers are closed vessels in which water or other fluids are heated. The heated or vaporized fluids exit the boiler for use in various processes or heating applications. In particular, utility boilers, which are typical drum-type boilers, are widely used in power plants, oil refineries, and petrochemical plants for steam generation to drive large turbines, producing electricity. In many instances, these boilers are coal-fired using coal at the burner to produce heated gases used to heat water, thereby generating steam.

Several decades ago, large utility boilers were fitted with pulverized-coal burners designed to fire pulverized coal using about fifteen percent to about twenty percent excess air. Under such conditions, the amount of unburned fuel normally was below two percent, although NOx levels generated by such burners reached levels that are now unacceptable according to current emission standards. In order to meet the current emission standards, low NOx burners have been developed and most commercial coal-fired boilers have been retrofitted with these low NOx burners. Low NOx burners operate to minimize NOx formation by introducing coal and its associated combustion air into a boiler such that initial combustion occurs in a manner that promotes rapid coal devolatilization in a fuel-rich (i.e., oxygen deficient) environment and introduces additional air to achieve a final fuel-lean (i.e., oxygen rich) environment to complete the combustion process. Using these low NOx burners reduces the NOx emissions up to about fifty to about sixty percent.

An example of a low NOx combustion system, such as a boiler with a low NOx burner, available from GE Power Systems is illustrated in FIG. 1. Such a system can include a reburn zone including reburn fuel injectors. The reburn zone is a technology that utilizes fuel and air staging to reduce the NOx emissions by integrating low NOx burners and over-fire air systems. Reburning is defined as reducing the coal and combustion air to the main burners and injecting a reburn fuel, such as coal, gas or oil, to create a fuel-rich secondary combustion zone above the main burner zone and final combustion air to create a fuel-lean burnout zone. The formation of NOx is inhibited in the main burner zone due to reduced combustion intensity, and NOx is destroyed in the fuel-rich secondary combustion zone by conversion to molecular nitrogen. A summary of GE Power System's technology is included in its publication entitled "Reburn Systems" having reference number GEA-13207, which is incorporated herein by reference.

However, the use of low NOx burners increases the carbon content, or unburned coal, in the boiler ash. FIG. 2 depicts measurements taken from a utility boiler firing a ten percent ash coal. The results show the increase of carbon in ash content after retrofitting the boiler with low NOx burners. Although the increase of the amount of unburned carbon can also be boiler and coal dependent, Table 1 shows a common trend toward the increase of carbon in ash data from several boilers fitted with low NOx burners.

TABLE 1

Select Boilers for Which Detailed Carbon in Ash Analyses Have Been Performed

| Firing Configuration | MWe | Low NO*x* System | Typical Measured NO*x* Emissions | Typical Measured Carbon in Ash Level |
|---|---|---|---|---|
| Opposed wall fired | 500 | FW CFSF burners with AOFA | 313 ppm | 5% |
| Opposed wall fired | 500 | FW CFSF burners without OFA | 310 ppm | 8% |
| Single wall fired | 160 | DBRiley CCVII burners and OFA | 245 ppm | 22-27% |
| Tangentially Fired | 900 | ABB LNCFS Level III | 275 ppm | 8-12% |

The disposal of boiler ash with increased carbon content is becoming a pressing issue within the power utilities markets and will continue to be more so in the future, as the cost of coal and other fuels continue to rise.

One method of utilizing coal as a fuel for utility burners is to create a slurry or dispersion of the coal. For example, the coal is pulverized and mixed with an amount of water in order to form a dispersion or slurry of coal in water at a low enough viscosity so as to enable transportation of the fuel via pipeline or the like. However, because the pulverized or micronized coal is only available at the particle sizes described above, the pulverized coal does not completely burn, and therefore the coal in water slurry does not solve the issues of high carbon content in boiler ash as described above.

Gas turbines can also utilize coal as fuel. A gas turbine is a rotary machine, similar in principle to a steam turbine. It consists of three main components—a compressor, a combustion chamber and a turbine. Air, after being compressed into the compressor, is heated either by directly burning fuel in it or by burning fuel externally in a heat exchanger. The heated air, with or without combustion products, is expanded in a turbine resulting in work output, a substantial part of which is used to drive the compressor. The excess is available as useful work output. In one example, a gas turbine has an upstream air compressor mechanically coupled to a downstream turbine, with a combustion chamber positioned in between. Energy is released when compressed air is mixed with fuel, such as coal, which is then ignited in the combustion chamber. The resulting gases are directed over the turbine's blades, spinning the turbine, and mechanically powering the compressor. Finally, the gases can be passed through a nozzle, generating additional thrust by accelerating the hot exhaust gases by expansion back to atmospheric pressure. Energy is extracted in the form of shaft power, compressed air and thrust, in any combination, and used to power aircraft, trains, ships, electrical generators, and even tanks.

However, commercially available coal-in-water slurries are not conducive to gas turbine applications. When the pulverized or micronized coal is combined with the compressed air and burned, the presence of unburned coal particles can damage the turbine blades, resulting in a less efficient process, and significant expense in replacing the turbine blades.

In diesel engines, a diesel engine relies upon compression ignition to burn its fuel. If air is compressed to a high degree, its temperature will increase to a point where fuel will burn upon contact. Following intake, the cylinder is sealed and the air charge is highly compressed to heat it to the temperature required for ignition. As the piston approaches top dead centre (TDC), fuel oil is injected into the cylinder at high pressure, causing the fuel charge to be nebulized. Owing to the high air temperature in the cylinder, ignition instantly occurs, causing a rapid and considerable increase in cylinder temperature and pressure. The piston is driven downward with great force, pushing on the connecting rod and turning the crankshaft. If commercially available coal-in-water slurries are used as the fuel, the presence of unburned coal particles after combustion of these fuels can cause damage to the cylinders, such as damaging the tolerances between the piston and the cylinder. This in turn may cause damage or failure to the seal of the cylinder, resulting in a lack of pressure to increase the temperature to ignite the fuel, for example.

Coal can also be used as a combustion fuel for a gasification process. Gasification is a process that converts carbonaceous materials, such as coal, petroleum, or biomass, into carbon monoxide and hydrogen by reacting the raw material at high temperatures with a controlled amount of oxygen. The resulting gas mixture is known as synthesis gas or syngas, which can in turn be used as a fuel. The syngas product can be burned directly as a fuel in internal combustion engine, processed into high-purity hydrogen, ammonia, methanol, and other chemicals, or converted via the Fischer-Tropsch process into synthetic fuel. However, commercially available coal-in-water slurries produce a lower quality or contaminated syngas because of the presence of unburned coal particles, as well as clogging of the particulates in the input stream. One example of a gasification process is the Texaco Gasification Process entitled "EPA: Site Technology Capsule—Texaco Gasification Process" having reference EPA 540/R-94/514a of April 1995, which is incorporated herein by reference.

There remains a need for a "green" coal to be used as in a coal-in-water slurry as a fuel for multiple applications including low NOx burners, gasification processes, gas turbine applications, diesel engine applications, and the like. Such "green" coal should completely burn, leaving no coal particulates in the downstream ash, products, and/or byproducts.

SUMMARY OF THE INVENTION

The present invention overcomes the above-described deficiencies. In one embodiment of the invention, a nano-dispersion of coal in water creates a relevant colloidal fraction slurry that can include from about fifty to about eighty weight percent, and more particularly about sixty to about seventy weight percent of coal. In one embodiment of the invention, the coal slurry has a relatively narrow particle size distribution with virtually no particles above 100 microns, about forty percent of the coal having a particle size of at least less than ten microns, and at least ten percent of the coal having a particle size of one micron or less. The total coal content of this kind of relatively narrow particle size distribution has an upper limit of sixty to sixty two weight percent and the viscosity of the coal slurry is about 1000 centipoise (cP) or less at 120 degrees Fahrenheit.

In another embodiment of the invention, the heat derating can be decreased significantly by increasing the coal content up to seventy to seventy two weight percent. This can be achieved by combining the relevant colloidal fraction coal slurry with dry large coal particles or slurry of large coal particles that can be at least one hundred times larger than the colloidal coal particles. By this means, coal content may be increased up to seventy to seventy two weight percent with virtually no increase in slurry viscosity creating a pseudo-fluid. The mass fraction of the large particle size coal is about 25 to 35% of the total coal in the slurry.

In another embodiment of the invention, the heat of combustion can also be increased by adding to the coal in water slurry a volatile or water-soluble fuel such as methanol, ethanol, propanol, butanol and glycerol. The component can also be an organic immiscible phase such as spent oil engine, hydrocarbons as heavy crude oils and bitumen, diesel, petroleum coke, biodiesel and biomass. The organic immiscible phase is preferably dispersed into nanodroplets or nanoparticles that enhance coal heat of combustion.

In another embodiment of the invention, the coal slurry also includes from about 500 to about 3000 ppm of one or more surfactants and/or an inorganic or organic salt. The surfactants can be ionic or nonionic. The nonionic surfactants can include, for example, primary or secondary ethoxylated alcohols with two to thirty ethoxylate oxide molecules, or ethoxylated nonylphenols with two to thirty ethoxylate oxide molecules. The ionic surfactants can include sodium alkyl sulfates, sodium alkyl sulfonates, alpha olefin sulfonates, alpha olefin sulfates, alkyl benzene sulfonates, sodium sulphosuccinates, sodium lauryl ether sulphate, quaternary ammonium chloride, bromide, or imidazolines or betaines. The inorganic and organic salt cations can include sodium, calcium, or magnesium.

In yet another embodiment of the invention, a method for preparing a coal in water slurry includes optionally mixing the components in the presence of one or more of the aforementioned chemical additives. The water phase may contain miscible and volatile components such as methanol, ethanol, propanol, butanol and glycerol or inmiscible oil nanodroplets or nanoparticles from biomass. The slurry is mixed in a chamber with a slit channel that spins a film of the slurry components and creates a centrifugal field in excess of thirteen thousand gs. Stagnation regions in the mixing flow field concentrate the coal, and then mill it in a wet-communication process. Cooling agents, in order to maintain water temperature below evaporation, control the mixing temperature.

In another embodiment, the coal in water slurries having nano-dispersions of coal can be used in low NOx burners as a main fuel, reburn fuel or both, as fuel in gasification and oxycoal processes, as a fuel in diesel engine applications, and/or as fuel in gas turbine applications and fuel cells.

The above summary of the invention is not intended to describe each illustrated embodiment or every implementation of the present invention. The figures and the detailed description that follow more particularly exemplify these embodiments.

DETAILED DESCRIPTION OF THE INVENTION

Nano-dispersions of coal-in-water slurries that contain a relevant colloidal fraction according to embodiments of the current invention solves the above-mentioned deficiencies. The coal-in-water slurry generally comprises a colloidal suspension or nano-dispersion of milled coal particles in water, the coal particles having a large particle population of sub-micron size. The coal-in-water slurry can further comprise a surfactant system that is particularly formulated depending on the type and source of coal. The coal-in-water slurry can be used as a fuel for not only the reburn and/or main fuel in a low NOx burner, but also has potential applications in gasification processes, gas turbines, and diesel engines. Because of the coal's small particle size, and therefore larger surface area compared to commercially available coal-in-water slurries, a burning efficiency of the coal is near one hundred percent, leaving virtually no coal particles in the ash or the resulting gases.

Figure 1:
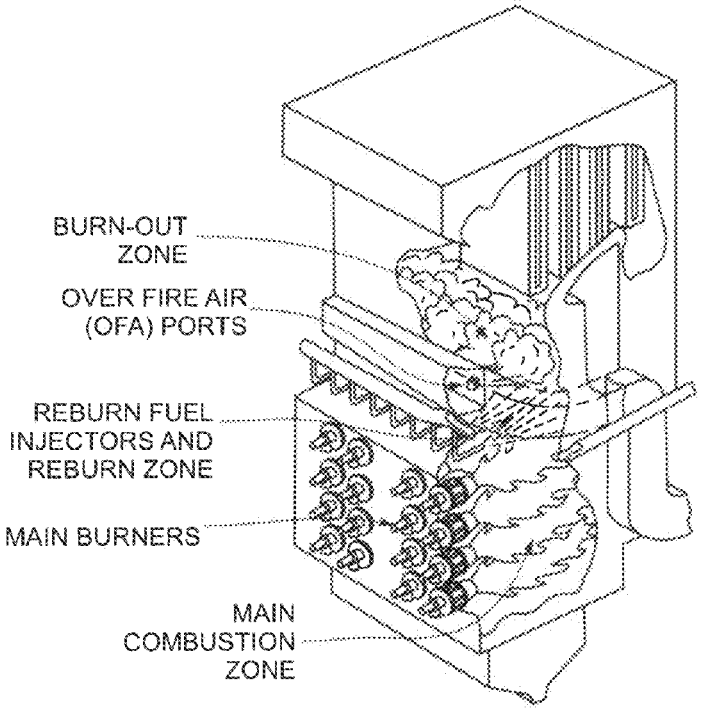
FIG. 1 depicts a schematic of a utility boiler having a low NOx burner.
Figure 2:
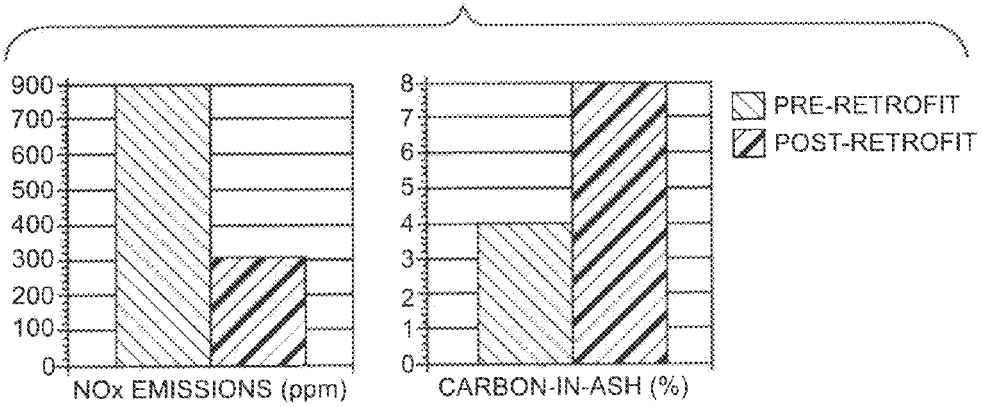
FIG. 2 is a graph of the NOx emissions and the carbon-in-ash percentage in a conventional utility boiler and a utility boiler retrofitted with a low NOx burner using a coal in water fuel of the prior art.
Figure 3:
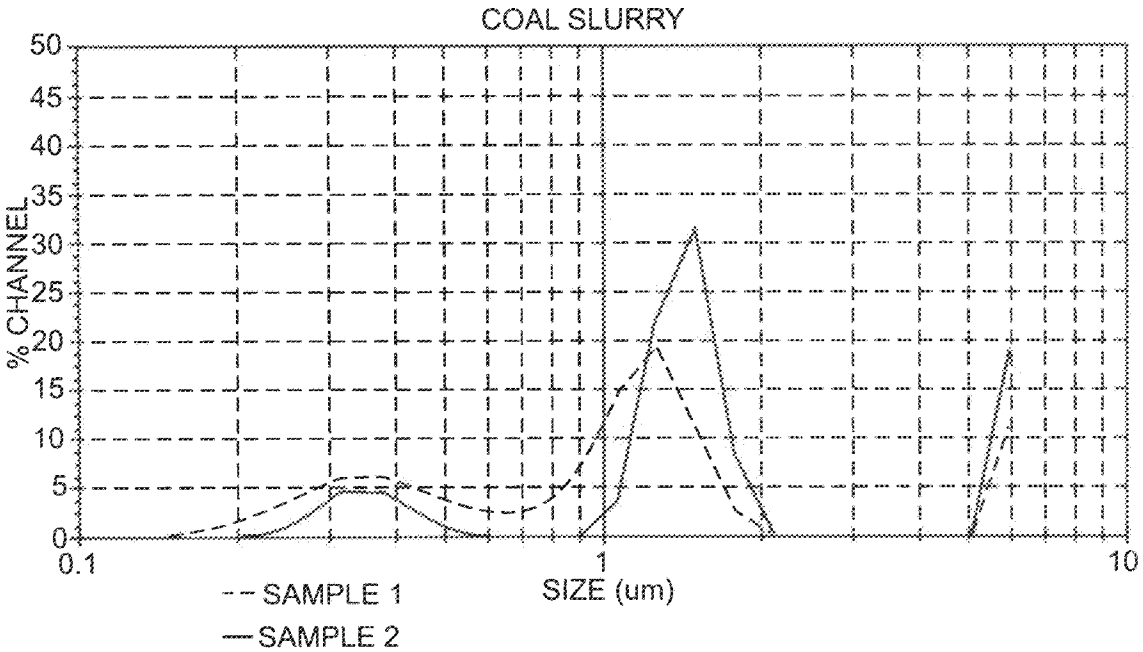
FIG. 3 is a graph of the particle size distribution of coal-in-water slurries according to embodiments of the invention.

In one embodiment of the invention, a coal-in-water slurry comprises from about fifty to about seventy two weight percent of coal dispersed in water, and more particularly from about sixty to about seventy weight percent of coal. The coal can comprise suitable coals to be used as fuel, such as, for example, lignite, sub-bituminous, bituminous, and anthracite. The coal particle size distribution can include, for example, between about thirty and fifty weight percent particles having a particle size of about ten microns or less, and at least about twenty weight percent to about eighty weight percent particles having a particle size of about one micron to about 100-150 nm of measurable particles or less, with the mode of the sub-micron size being about 200 nanometers to about 300 nanometers. A person of ordinary skill in the art will recognize that ranges and subranges within these explicit ranges are contemplated and are within the present disclosure. In a preferred embodiment, the sub-micron sized coal particles comprise about forty to about fifty weight percent with a coal particle size mode of about 250 nanometers. In one embodiment of the invention, the particle size distribution is bimodal, having one mode of about one micron or less. In an alternative embodiment of the invention, the particle size distribution is unimodal with a mean particle size of about five microns or less. A multi-modal particle size distribution of coal-in-water slurries according to an embodiment of the invention is shown at FIG. 3.

In one embodiment of the invention, the coal-in-water slurry has a viscosity of about 350 to about 1000 centipoise (cP) at 120 degrees Fahrenheit. A person of ordinary skill in the art will recognize that ranges and subranges within these explicit ranges are contemplated and are within the present disclosure. A viscosity at the lower end of this range allows for standard fuel transportation means, such as, for example, pipelining, tanker trucks, and ships and barges. Further, by virtue of the coal's small particle size, the suspension is relatively stable, with very little sedimentation.

In certain embodiments, nano-dispersions of coal in water according to the present invention have a maximum amount of dispersed coal, which when surpasses causes the nano-dispersion to lose its pseudo-fluid characteristic. This has to do with coal particles running out of space in the bulk of the water as more coal is added. The upper bound of coal content depends on the way coal particles arrange among themselves which, in turn, depends on the geometry of the entire coal particle assembly. This non-unique upper bound is known as the maximum packing fraction. When the coal content approaches this mass fraction, particle interactions are greatly increased because particles virtually touch each other; once the slurry surpasses the maximum packing fraction, the slurry no longer behaves like a fluid but rather as a wet solid or paste. As a consequence, slurry fluidity diminishes significantly. Besides, colloidal interactions also contribute to paste like behavior. However, modifying particle size distribution, in such a way as to reduce local interactions, can increase the maximum packing fraction. This can be achieved by combining large particles with much smaller particles, at least 100 times smaller. The smaller particles, along with the continuous phase, become a pseudo-continuous fluid to the large particles. The resulting macroscopic effect is a significant reduction of viscosity, as long as the size ratio of large particles to small particles is greater than 100.

In one embodiment of the present invention, about fifty eight to about sixty two weight percent nano-dispersed coal in water slurry, as described above, is manufactured followed by the addition of dry large coal particles or a concentrated slurry of large coal particles, having particles sizes in the range of 150 to 400 μm. A person of ordinary skill in the art will recognize that ranges and subranges within these explicit ranges are contemplated and are within the present disclosure. This procedure gives way to more concentrated coal slurry, with about sixty eight to about seventy two weight percent of coal, with sub-ranges and values within this range contemplated and present within this disclosure, and a broad particle size distributions, still having a significant colloidal fraction that behaves as a pseudo-fluid to the large particles. Since this pseudo-fluid is more viscous than the continuous phase alone, sedimentation of both the sub-micron and the large particles is virtually eliminated because the relevant colloid fraction creates a viscous pseudo-fluid that suspends the large particles. In other words, the density difference between the coal particles and the pseudo-fluid to prevent sedimentation is about less than 10%, preferably less than 5%, and optimally 2% or less. This behavior has an important economic implication. Since the viscous pseudo-fluid prevents sedimentation, there is no need of additional chemical compounds to prevent settling (polymers, for example, that are necessary in conventional slurries) thereby reducing additives cost in a significant way.

Coal slurries of the present invention in which the coal content is greater than sixty two percent are of interest in gasification and oxy combustion processes. In these applications, boiler temperatures are very high thus allowing complete coal burning while gaining thermal efficiency associated with less boiler de-rating owing to the reduced water content in the slurry fuel.

In yet another embodiment of the invention, a volatile water miscible component, that also has combustion properties, can be added to increase heat of combustion. The volatile component can be methanol, ethanol, butanol and glycerol, or a combination thereof. While the optimal amount of volatile component is dependent upon the volatile being added, in certain embodiments the preferred weight percent of the volatile component is less than 10%, and optimally 3-6%. A person of ordinary skill in the art will recognize that ranges and subranges within these explicit ranges are contemplated and are within the present disclosure. Methanol, ethanol and butanol are water soluble and volatile, and they can be obtained as sub-products of biomass fermentation. Biodiesel production from vegetable oils transesterification implies, in some cases, the generation of high volumes of glycerol solutions that can be combined with coal to produce a higher heat value for the fuel slurry.

In another embodiment of the invention, the heat of combustion can also be increased by adding to the coal water slurry, an organic liquid or oil that is immiscible in water. The organic liquid or oil would also be a nano-dispersion, this is, an oil-in-water nanoemulsion. The organic or oil phase can consist of spent engine oil or lube oil, crude oil and bitumen, diesel and biodiesel or any other hydrocarbon product that is emulsified in the water phase, previous to the preparation of the coal slurry. Alternatively, the organic or oil phase can also be combined with the previously prepared coal in water suspension. In certain embodiments, the preferred weight percent of the organic liquid or oil component is less than 10%, and optimally 3-6% with other ranges and subranges within these explicit ranges being contemplated and within the present disclosure.

In another embodiment of the invention, adding to the coal in water slurry, finely dispersed solid particles that are combustible, can also increase the heat of combustion. The origin of the combustible solid particles may be biomass, or alternatively petroleum coke. The solid dispersion can be the base for the preparation of coal slurry, or the solid particle slurry can be the base for the incorporation of the coal into the slurry. In certain embodiments that contain the finely dispersed solid combustible particles, the nano-dispersion of coal-in-water contains about fifty eight to about sixty two weight percent nano-dispersed coal in water slurry, as described above, with the remaining weight percent of the particles dispersed in water comprising the solid combustible particles of biomass, petroleum coke, or a combination thereof. A person of ordinary skill in the art will recognize that ranges and subranges within this explicit range are contemplated and are within the present disclosure.

In yet another embodiment of the invention, the coal-in-water slurry comprises a surfactant system. Not all sources of coal have the same properties, but rather the surface properties of coal can depend on the type and/or source of the coal being used. Therefore, surfactant systems can be carefully tailored to each type and/or source of coal. Further, if a volatile or combustible component is added to the slurry, the surfactant system has to ensure the dispersability and stability of the coal particles in an aqueous phase that may have soluble components (methanol, ethanol, propanol, butanol, glycerol), or oil droplets (spent engine and lube oil, diesel and biodiesel, crude oil or bitumen) or a second type of combustible solid particles (biomass).

A surfactant system according to embodiments of the invention can comprise a single surfactant, a mixture of two or more surfactants, or mixtures of one or more surfactants and an inorganic and/or organic salt. Suitable surfactants can comprise one or more nonionic surfactants and/or one or more ionic surfactants. Nonionic surfactants can include, for example, primary or secondary ethoxylated alcohols having two to thirty ethoxylate oxyde molecules, and/or ethoxylated nonylphenols having two to thirty ethoxylate oxyde molecules. Ionic surfactants can include, for example, sodium alkyl sulfates, sodium alkyl sulfonates, alpha olefin sulfonates, alpha olefin sulfates, alkyl benzene sulfonates, sodium sulphosuccinates, sodium lauryl ether sulphate, quaternary ammonium chloride, quaternary ammonium bromide, imidazolines, betaines, and combinations thereof. Cations of suitable inorganic and organic salts can include, for example, sodium, calcium, and/or magnesium.

In one embodiment of the invention, a surfactant system is present in the coal-in water-slurry at about 500 to about 3000 parts per million (ppm). A person of ordinary skill in the art will recognize that ranges and subranges within this explicit range are contemplated and are within the present disclosure. In another embodiment of the present invention, a surfactant system of about up to 1 weight percent is included in the nano-dispersion of coal-in-water when the slurry contains at least one volatile component and/or at least one organic liquid or oil component.

Figure 4A:
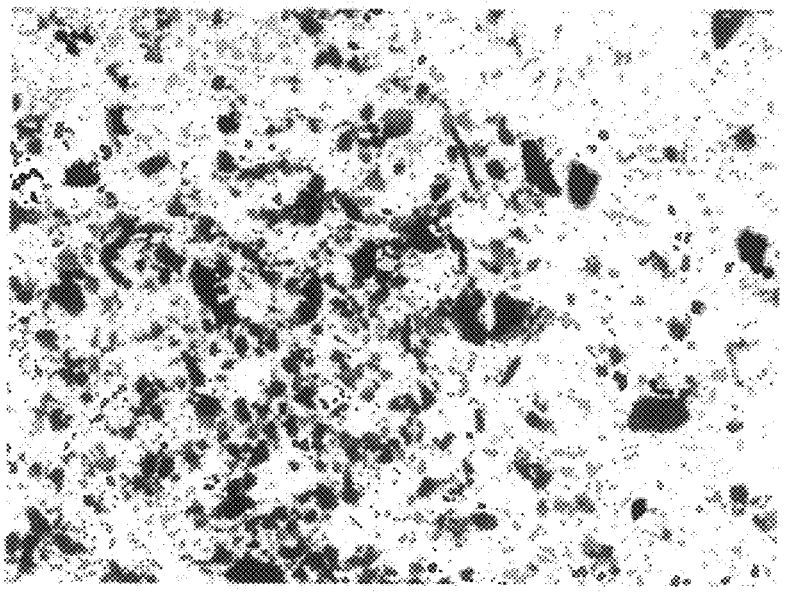
FIG. 4A is a micrograph depicting a coal in water slurry using micronized coal, according to the prior art.
Figure 4B:
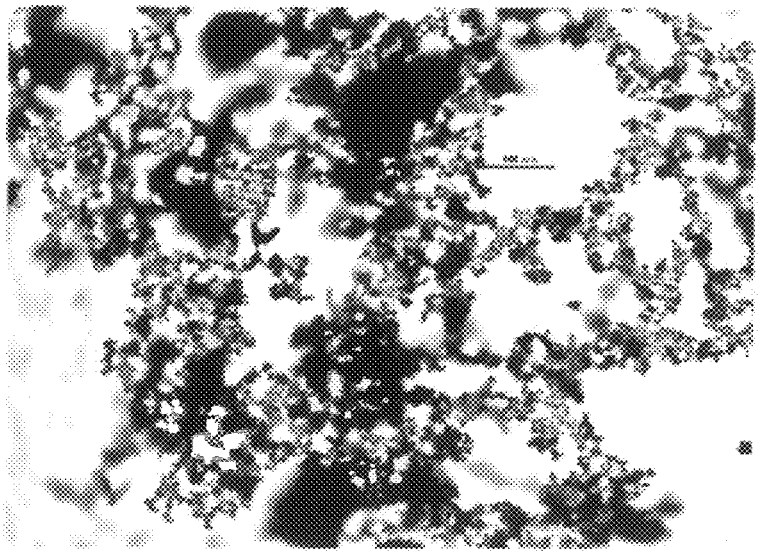
FIG. 4B is a micrograph depicting a nano-dispersion of coal in water, according to an embodiment of the present invention.

A method of making coal-in-water slurries is dependent upon the milling technology in order to produce coal particles in the sub-micron range. In one embodiment of the invention, pulverized or non-pulverized coal, water, and optional surfactant system are combined in a chamber of a suitable mixer, such as, for example, the Filmics Mixer, available from the Primix Corporation of Osaka, Japan. The Filmics Mixer and accompanying technology is set forth in U.S. Pat. No. 5,582,484 entitled "Method Of, and Apparatus For, Agitating Treatment Liquid", which is incorporated herein by reference. The slurry is mixed in the chamber with a slit channel that spins a film of the slurry components and creates a centrifugal field of about thirteen gs or more. Stagnation regions in the mixing flow field then concentrate the coal and mill the coal in a wet-comminution process, milling the coal into the micron and submicron particles as previously disclosed. In a preferred embodiment, the wet-comminution process is a continuous process with the source of coal having about 3 to about 20 seconds of residence time, optimally about 9 seconds, with other ranges and subranges of these explicit ranges contemplated and within the present disclosure. The formation temperature of the slurry is controlled by cooling agents to maintain the water temperature below evaporation. Coal particles micronized by milling according to commercially standard processes are shown in FIG. 4A. In contrast, coal particles milled to submicron particles as described above are shown in FIG. 4B.

This wet-comminution process also offers safety advantages over dry milling. Dry milling coal, such as that done in a Fuller mill, to a micron or submicron size can cause the coal particles to be released into the air. Often times, costly sophisticated systems, such as magnetic fields, are used to control the release of the coal particles. However, the wet-comminution process allows the coal particles to remain suspended in the water, reducing or eliminating the introduction of coal particles into the air.

In yet another embodiment of the invention, if a volatile or combustible component is required to decrease heat derating, which may be an ignition problem with the additional dividend of reduced derating, the slurry preparation may require two mixing steps. In the first step, water is combined with soluble alcohols (i.e., methanol, ethanol and/or butanol) and/or glycerol and then coal and aqueous phase are mixed and processed in the wet-comminution apparatus. Alternatively, the soluble alcohols and/or glycerol are added to the coal slurry after the wet-comminution process. Regarding the combination with an organic or oil phase, or a finely dispersed solid biomass, the wet-comminution process is used to produce a nanoemulsion (organic or oil phase) or nanosuspension (dispersed solid biomass) that is later combined with coal water slurry that has also been produced by the wet-comminution process. In a variant of the present invention, the nanoemulsion is produced by a conventional mixer using a special surfactant package, or by means of the wet-comminution method and the special surfactant package. In yet another alternative embodiment, the wet-comminution process is used to produce first the nanoemulsion or nanosuspension, and then used again to mill the coal into micron and/or submicron size in the nanoemulsion or nanodispersion.

Figure 5:
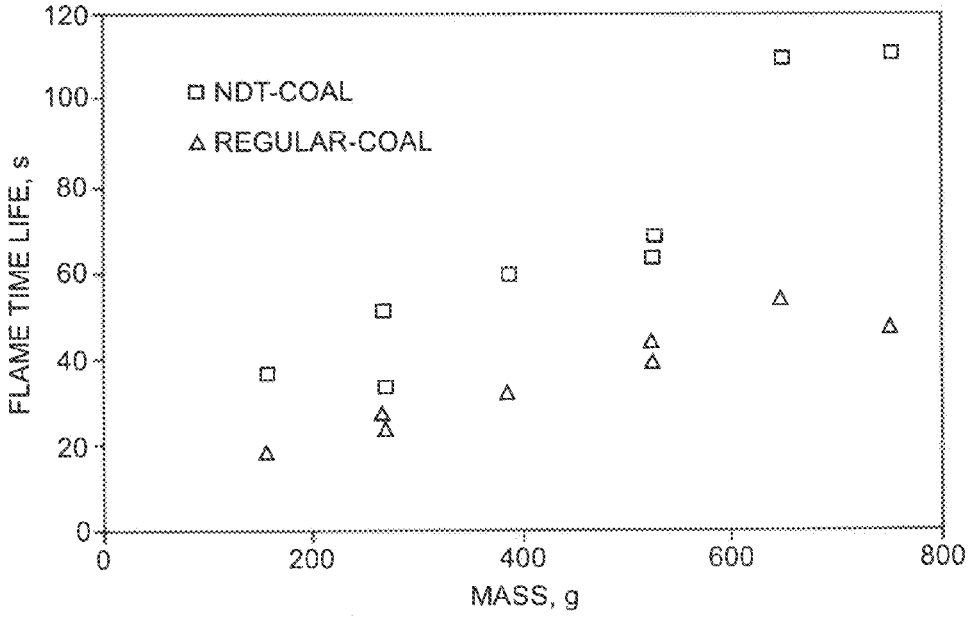
FIG. 5 is a graph comparing the flame time of a coal-in-water slurry of the prior art to the coal-in-water slurry of the present invention.

According to one embodiment of the invention, the coal-in-water slurry with nano-dispersed particles can be used as the main fuel, the reburn fuel, or both, in a boiler, such as a low NOx boiler. The small particle size of the coal particles in the coal-in-water slurry increases the surface area available for firing or burning, as compared to commercially available micronized coal-in-water slurry. The increased surface area results in increased flame times twice as long or more compared to commercially available slurries, and virtually complete or clean burning of the slurry and coal particles, even in low oxygen atmospheres. A graph comparing the flame times of commercial slurries and the slurries of the present invention is illustrated at FIG. 5.

Because of the clean burning characteristics of the nano-dispersion of coal-in-water slurry of the present invention, there is virtually no coal present in the ash in boiler applications. This clean burning application can therefore reduce the amount of coal needed for power generation than the current low NOx burners, producing a savings of upwards of millions of dollars a year on coal supplies.

Figure 6:
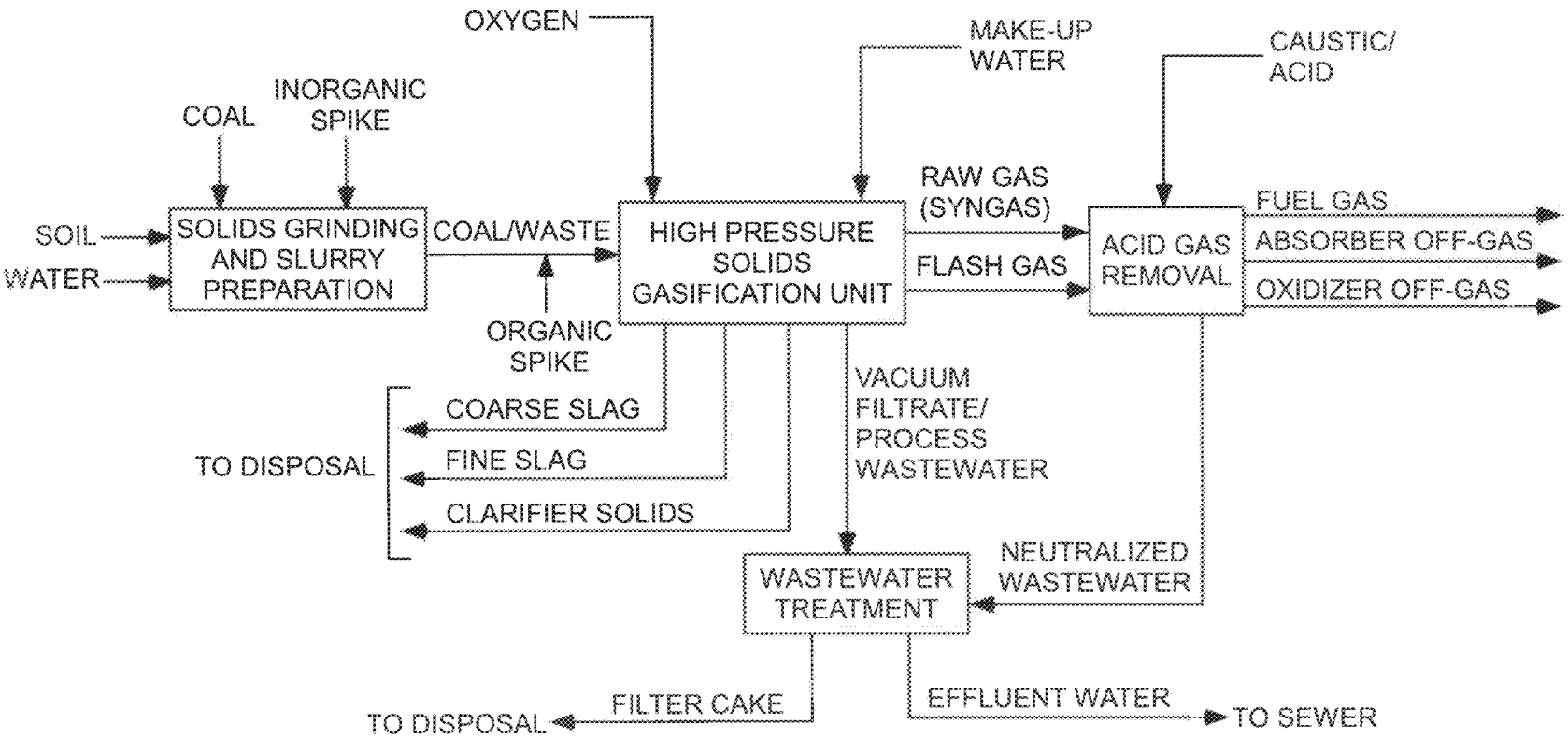
FIG. 6 depicts a block flow diagram of a commercial gasification process.

In another embodiment of the invention, the coal-in-water slurry with nano-dispersed coal particles can be used in gasification processes, such as the Texaco Gasification Process previously referenced. FIG. 6 depicts a standard gasification process flow diagram. The input oxygen to slurry ratio of the gasification process must be closely controlled in order to produce quality syngas. For example, commercially available slurries often cause spikes in the syngas due to fluctuations of the oxygen and slurry ratio. The larger particle size of the coal particulates can cause clogging of particulates at the input to the reaction chamber. However, because of the smaller particle size of the coal particulates of the current invention, the slurry acts more closely to a fluid, following a fluid path creating a consistent input of coal particles to the reaction chamber, thereby reducing syngas spikes. The result is a higher quality syngas, free of coal particulates. The higher quality syngas can then be used to produce higher quality chemical or synthetic fuel end products, and higher quality marketable byproducts.

In yet another embodiment of the invention, the coal-in-water slurry with nano-dispersed particles can be used in gas turbine applications. For example, methanol, ethanol, glycerol or any other similar fluid hydrocarbon can be added to the slurry to create a water/alcohol or polyalcohol mixture with coal particles for a fuel. Because the coal burns essentially completely, there are no coal particles in the resulting gases from the combustion chamber. Therefore, there is a little danger of damaging the turbine blades.

The virtual elimination or mass reduction of coal particles in the combustion of the coal-in-water slurries of the present invention also allows one to use them as fuels in diesel engines, such as marine diesel engines, independent power producers (IPP) diesel engines, and standard diesel engines. The occurrence of damage to the cylinder and/or piston is greatly reduced due to the clean burning of the particles.

In yet another embodiment of the invention, the coal-in-water slurry of the present invention can be used in any application employing a Rankine cycle. The Rankine cycle is a thermodynamic cycle which converts heat into work. The heat is supplied externally to a closed loop, which usually uses water as a working fluid. There are four processes in the Rankine cycle, each changing the state of the working fluid: 1) the working fluid is pumped from low to high pressure, as the fluid is a liquid at this stage the pump requires little input energy; 2) the high pressure liquid enters a boiler where it is heated at constant pressure by an external heat source to become a dry saturated vapor; 3) the dry saturated vapor expands through a turbine, generating power—this decreases the temperature and pressure of the vapor, and some condensation may occur; and 4) the wet vapor then enters a condenser where it is cooled at a constant pressure and temperature to become a saturated liquid—the pressure and temperature of the condenser is fixed by the temperature of the cooling coils as the fluid is undergoing a phase-change. The Rankine cycle describes a model of the operation of steam heat engines most commonly found in power generation plants. However, because of the diesel applications that can be achieved using the coal-in-water slurry, the boiler of the Rankine cycle can be replaced with a diesel engine. Alternatively, the coal-in-water slurry can be used as the main fuel and/or reburn fuel of the boiler of the Rankine cycle, as discussed above.

The development of a super green coal to be used as coal-in-water slurry according to embodiments of the invention has the potential of massive savings in the applications as described above, and particularly in the low NOx burner applications because less coal is needed to produce the same amount of energy produced in today's applications. Further, the virtually complete burning of the coal reduces the amount of coal present in the waste streams, such as the ash of a boiler.

EXAMPLE

Combustion characterization studies were performed comparing colloidal coal-in-water slurries according to embodiments of the current invention to a slurry made with a conventional coal grind. The slurries were used in pilot-scale reburning tests to highlight any performance advantages to using a micronized coal water slurry product in terms of $NO_x$ reduction and carbon burnout as a reburn fuel compared with conventional coal water slurry. Nine reburn tests were conducted. Test variables included reburn zone residence time, reburn heat input, and initial $NO_x$ concentrations. The complete study is set forth in "NDT Combustion Characterization Studies," Oct. 27, 2008, which is incorporated herein by reference in its entirety. In the study, the nano-dispersion of coal in water was referred to as "micronized."

1. Equipment, Slurry Preparation, and Test Parameters

The reburning tests were conducted in a boiler simulation furnace (BSF) test unit that is designed to simulate a coal-fired boiler. The BSF used has a firing rate range of 200,000 to 1,000,000 Btu/hr. The atomization air flow rate was held constant and the air-to-liquid mass ration ranged from approximately 1.0 to 0.5 as reburn heat input varied from about 10-20%.

The conventional coal water slurry used as the reburn fuel for the test included a conventional grind with a size distribution such that approximately 70% of the material passed through a US 200 mesh sieve, typically used in US pulverized coal-fired boilers. The coal used as the base for the conventional coal water slurry is shown in the table below:

TABLE 3-1

ANALYSIS OF EASTERN BITUMINOUS COAL

| Parameter | Unit | Value |
|---|---|---|
| Ultimate Analysis: As Received | | |
| Carbon | % wt. | 70.30 |
| Hydrogen | % wt. | 4.86 |
| Nitrogen | % wt. | 1.37 |
| Sulfur | % wt. | 0.81 |
| Oxygen | % wt. | 7.63 |
| Ash | % wt. | 9.70 |
| Moisture | % wt. | 5.33 |
| Total | | 100.00 |
| As Received Heating Value | Btu/lb | 12.584 |
| Ultimate Analysis: Dry Basis | | |
| Carbon | % wt. | 74.26 |
| Hydrogen | % wt. | 5.13 |
| Nitrogen | % wt. | 1.45 |
| Sulfur | % wt. | 0.86 |
| Oxygen | % wt. | 8.06 |
| Ash | % wt. | 10.25 |
| Total | | 100.00 |
| Dry Heating Value | Btu/lb | 13.292 |

The water content of both the nano-dispersion and the initial conventional coal slurry was 40% by weight. However, it was readily apparent that the conventional slurry had different handling, pumping, and atomization characteristics than the nano-dispersion slurry. Specifically, the conventional slurry with 40% water had poor atomization quality and tended to plug the injection system. Therefore, to qualitatively simulate the handling and atomization characteristics of the nano-dispersion slurry, most conventional slurry reburning tests were performed with slurry containing 45% water. It was observed that even after shipment and storage for several weeks of the nano-dispersion slurry, the slurry did not settle in the containers and maintained good condition. On the other hand, the initial conventional coal slurry with 40% water by weight settled in the bottom of the storage container within a few hours.

Two series of reburning tests were performed, including one with nano-dispersion of coal in water slurry and one with conventional coal water slurry. The slurry was the reburn fuel, with natural gas as the main fuel. After stable emissions were verified during natural gas firing, slurry was pumped and atomized into the BSF furnace zone. $NO_x$ emissions were measured throughout the tests to determine the achievable $NO_x$ reduction, and for selected test conditions, ash samples were collected from the convective pass of the BSF and loss of ignition (LOI) was measured.

Test variables included reburning heat input ranging from about 10% to about 20% and varied by adjusting the reburn fuel flow rate, reburn zone residence time (240 to 590 ms) varied by moving the overfire air injector position, initial $NO_x$ concentration (250 to 400 ppm) varied by adjusting burner conditions, and slurry water content (40% and 45%). The following table sets forth the test matrix:

| Test Run | Reburn Fuel | Rb. Heat Input (%) | OFA Temp. (F.) | Rb. Zone Res. Time (ms) | NOx @ 0% O2 (ppm) | Atomization Medium | Fly Ash Sample |
|---|---|---|---|---|---|---|---|
| 1.1 | Micronized CWS | 10 | 2380 | 590 | 400 | Air | |
| 1.2 | Micronized CWS | 15 | 2380 | 590 | 400 | Air | |
| 1.3 | Micronized CWS | 20 | 2380 | 590 | 400 | Air | X |
| 1.4 | Micronized CWS | 10 | 2550 | 240 | 400 | Air | |
| 1.5 | Micronized CWS | 15 | 2550 | 240 | 400 | Air | |
| 1.6 | Micronized CWS | 20 | 2550 | 240 | 400 | Air | X |
| 1.7 | Micronized CWS | 10 | 2550 | 240 | 250 | Air | |
| 1.8 | Micronized CWS | 15 | 2550 | 240 | 250 | Air | |
| 1.9 | Micronized CWS | 20 | 2550 | 240 | 250 | Air | X |
| 2.1 | Conventional CWS | 10 | 2380 | 590 | 400 | Air | |
| 2.2 | Conventional CWS | 15 | 2380 | 590 | 400 | Air | |
| 2.3 | Conventional CWS | 20 | 2380 | 590 | 400 | Air | X |
| 2.4 | Conventional CWS | 10 | 2550 | 240 | 400 | Air | |
| 2.5 | Conventional CWS | 15 | 2550 | 240 | 400 | Air | |
| 2.6 | Conventional CWS | 20 | 2550 | 240 | 400 | Air | X |
| 2.7 | Conventional CWS | 10 | 2550 | 240 | 250 | Air | |
| 2.8 | Conventional CWS | 15 | 2550 | 240 | 250 | Air | |
| 2.9 | Conventional CWS | 20 | 2550 | 240 | 250 | Air | X |

BSF Conditions:

Primary Firing Rate: 712, 500 Btu/hr

SR1:1.1; SR3:1.2

Primary Fuel Natural gas

Reburn Fuel Location: Port 2.5, Injection Temperature: 2760F

2. Test Results

Figure 7A:
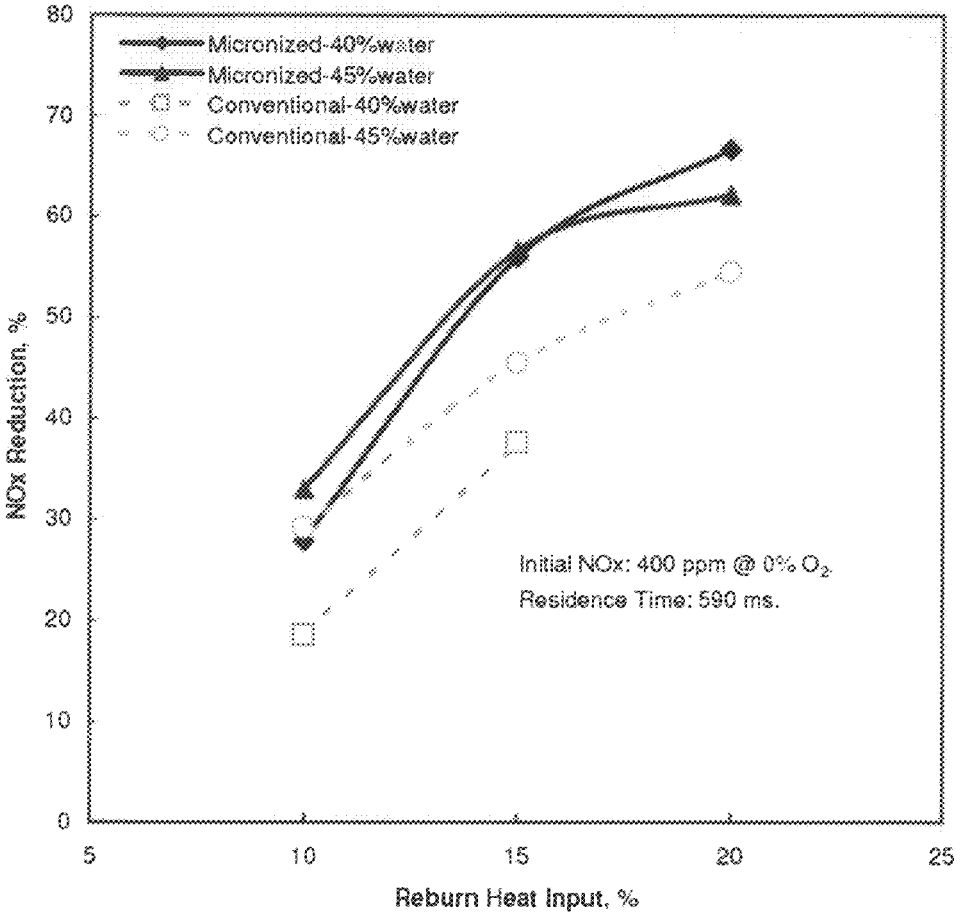
FIGS. 7A-7C are graphs comparing reburn heat input and NOx reduction.

At high initial $NO_x$ concentration (400 ppm) and long reburn zone residence time (590 ms), reburn performance of the micronized or nano-dispersion slurry at 10% and 15% reburn heat input is measurably better compared to the conventional slurry, as illustrated in the graph of FIG. 7A.

Figure 7B:
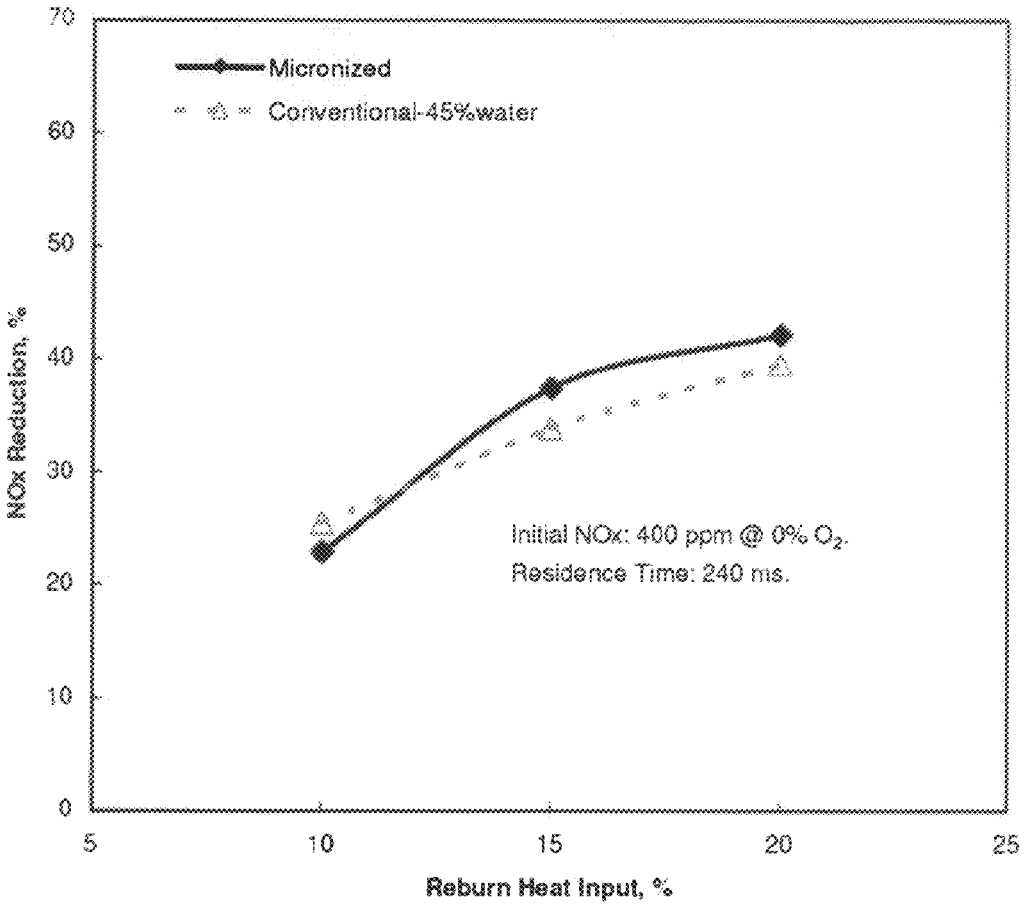

At high initial $NO_x$ concentration (400 ppm) and short reburn zone residence time (240 ms), the reburn performance for micronized slurry is slightly better compared to that of conventional slurry, as illustrated in the graph of FIG. 7B.

Figure 7C:
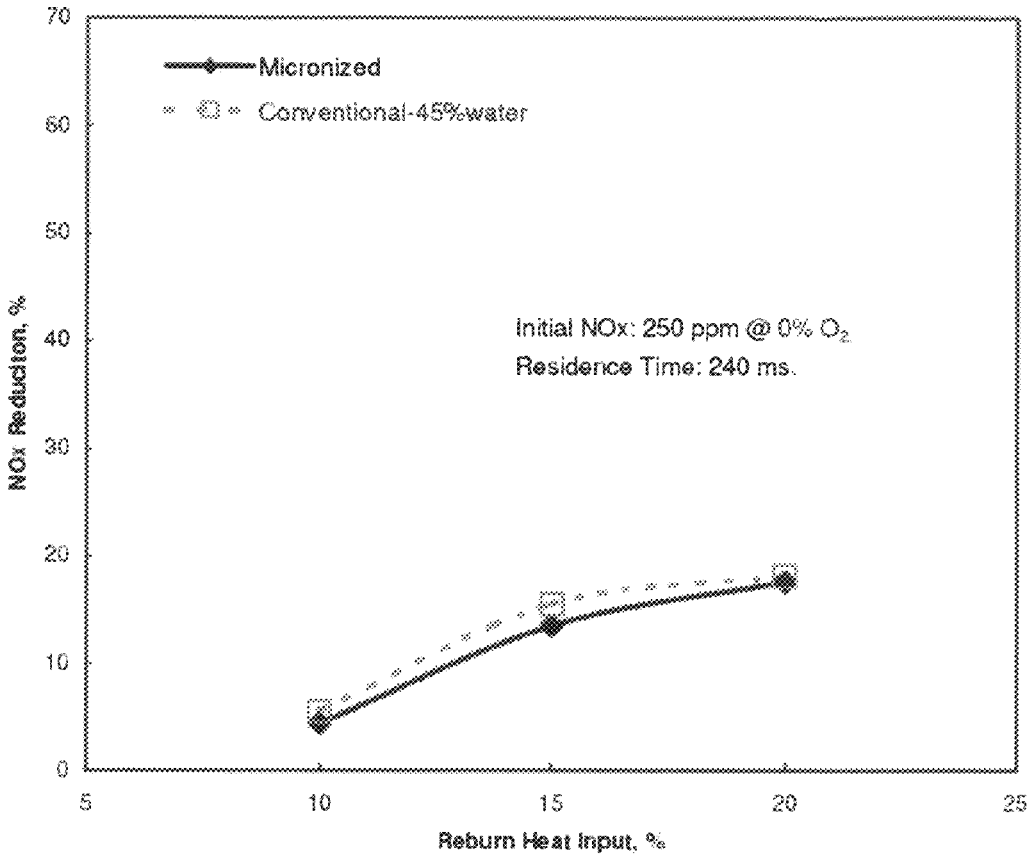

At low initial $NO_x$ concentration (250 ppm) and short reburn zone residence time (240 ms), the reburn performance of micronized 40% water slurry is comparable to that of 45% conventional slurry, as illustrated in the graph of FIG. 7C.

Figure 8:
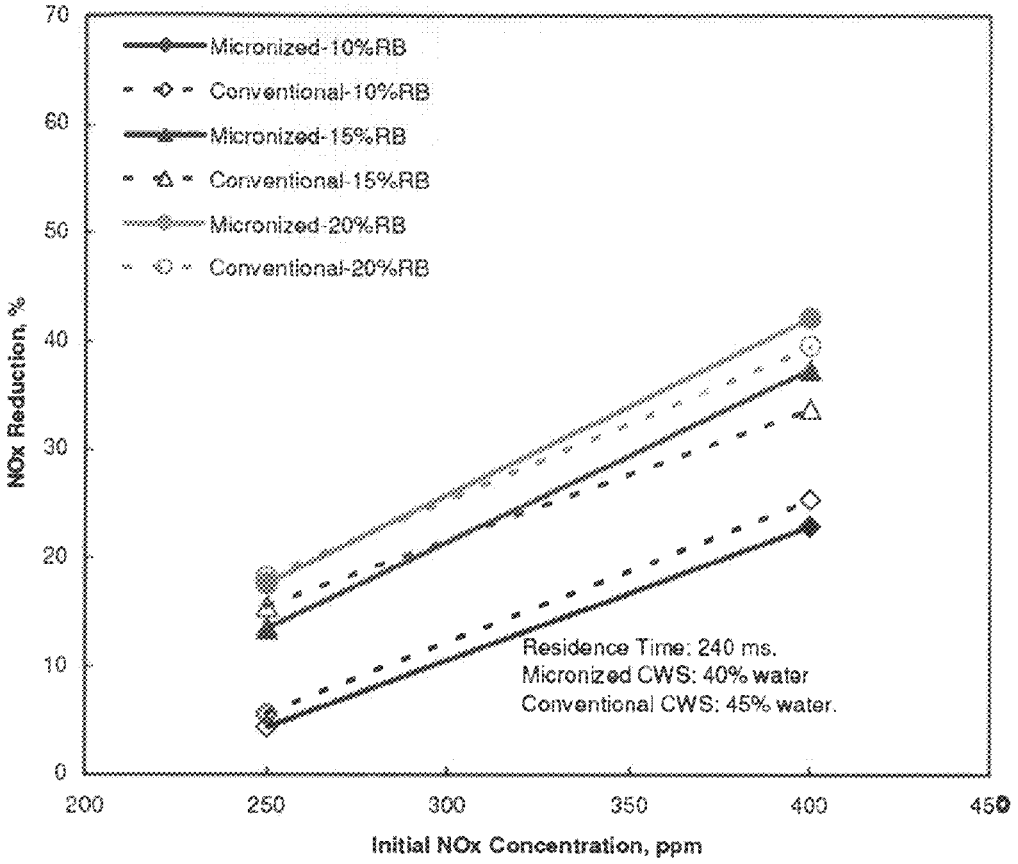
FIG. 8 is a graph comparing initial NOx concentration and NOx reduction.

The effect of initial $NO_x$ concentration on reburn performance while keeping the same reburn zone residence time (240 ms) was also measured. The reburn performance of 40% water micronized slurry appears to be better compared to that of conventional 45% slurry at 15% and 20% reburn heat input. Reburn performance for micronized and conventional slurry is comparable and within the same range at 10% reburn heat input, as illustrated in the graph of FIG. 8.

Figure 9:
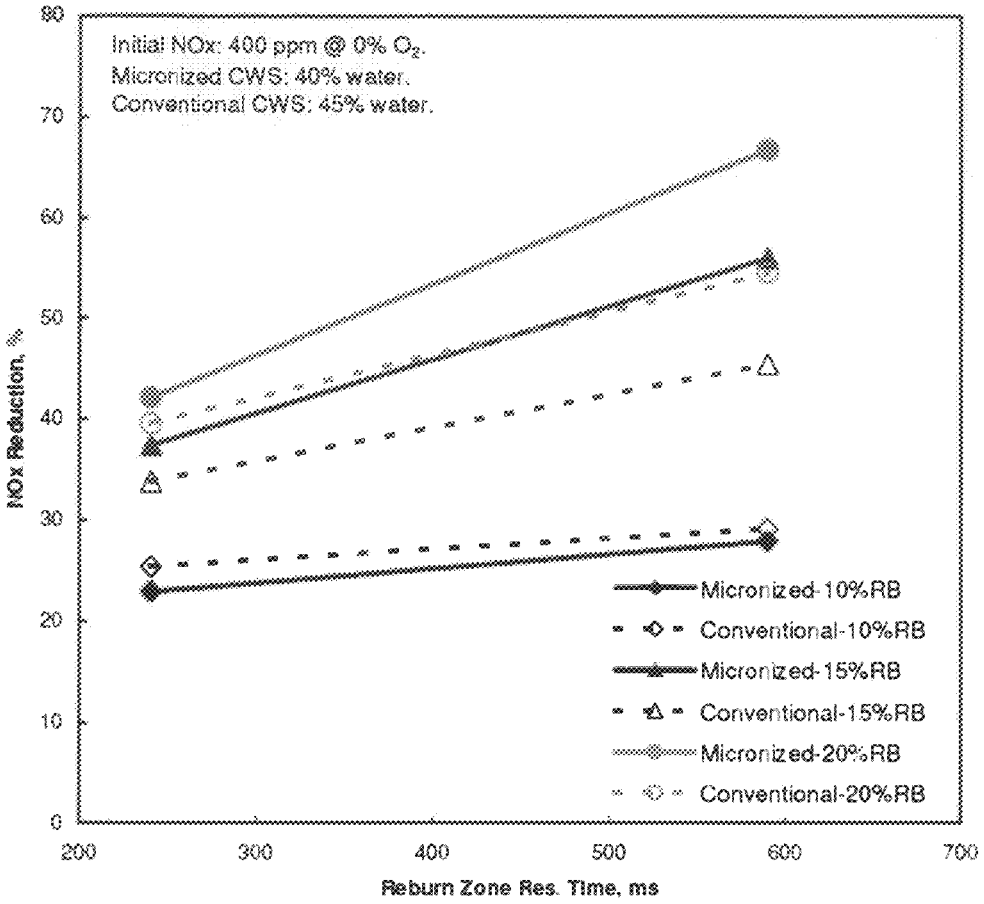
FIG. 9 is a graph comparing reburn zone residence time and NOx reduction.

The effect of reburn zone residence time on reburn performance while keeping same initial $NO_x$ concentration (400 ppm) was also measured. The reburn performance of micronized slurry appears to be better compared to that of conventional slurry at 15% and 20% reburn heat input. Reburn performance for both micronized and conventional slurry is comparable and within the same range at 10% reburn heat input, as demonstrated in the graph of FIG. 9.

Figure 10:
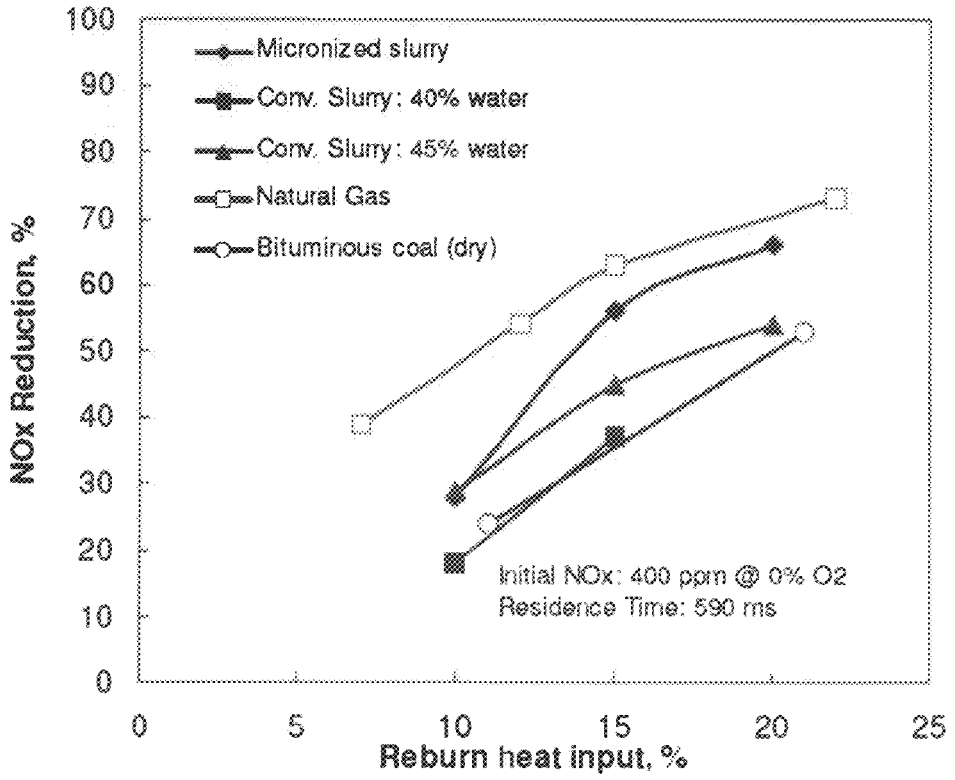
FIG. 10 is a graph comparing reburn heat input and NOx reduction.

The current coal-water slurry reburning results were also compared in the context of other reburning fuels that have been tested at the BSF. Natural gas is the most reactive of these fuels due to its ability to readily disperse and react. However, natural gas is also typically the most expensive reburning fuel, and thus there is commercial interest in utilizing other fuels such as coal for reburning. The micronized slurry was generated using a bituminous coal that on its own would not be expected to be highly reactive. The results are illustrated in the graph of FIG. 10.

Figure 11:
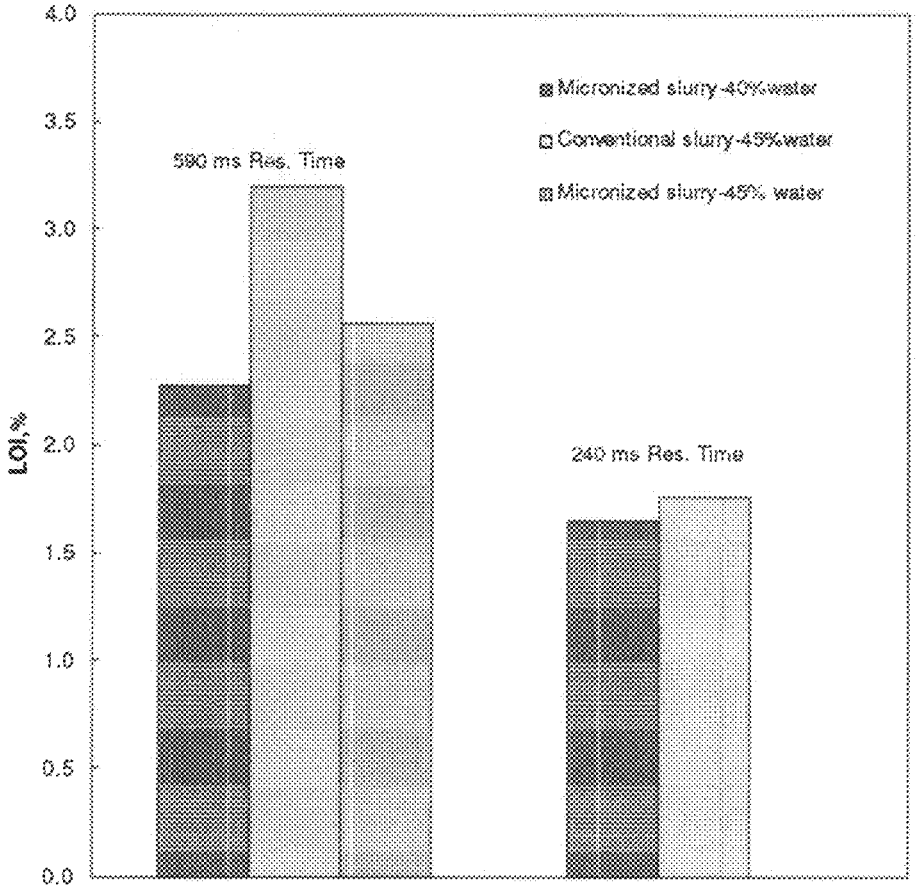
FIG. 11 is a bar graph comparing loss of ignition of the different slurries.

Three fly ash samples were collected and measured for loss on ignition (LOI) at 20% reburn heat input for both micronized and conventional slurry to determine if the micronized slurry is different from the conventional slurry in terms of carbon content in ash. The LOI is lightly lower for micronized slurry reburn tests for all test conditions, as illustrated in the graph of FIG. 11.

The following table is a summary of all test results, in which it was observed that for all the reburn test conditions, the micronized coal water slurry with 40% water performed better than the conventional coal water slurry with 45% water, and that for all reburn test conditions the micronized coal water with 40% water performed at least as well as, and in some cases better than, the conventional coal water slurry with 45% water. $NO_x$ reduction performance of micronized slurry appears to have more advantages at higher reburn heat inputs and longer reburn zone residence times. The values of Loss on Ignition results were slightly lower for reburn tests with micronized slurry than with conventional slurry.

| Test Run | Reburn Fuel | Water Content (%) | Rb. Heat Input (%) | Rb. Zone Res. Time (ms) | NOx @ 0% O2 (ppm) | NOx Reduction |
|---|---|---|---|---|---|---|
| 1.1 | Micronized CWS | 40 | 10 | 590 | 400 | 27.9 |
| 1.2 | Micronized CWS | 40 | 15 | 590 | 400 | 56.0 |
| 1.3 | Micronized CWS | 40 | 20 | 590 | 400 | 66.7 |
| 1.4 | Micronized CWS | 40 | 10 | 240 | 400 | 22.9 |
| 1.5 | Micronized CWS | 40 | 15 | 240 | 400 | 37.4 |
| 1.6 | Micronized CWS | 40 | 20 | 240 | 400 | 42.1 |
| 1.7 | Micronized CWS | 40 | 10 | 240 | 250 | 4.4 |
| 1.8 | Micronized CWS | 40 | 15 | 240 | 250 | 13.5 |
| 1.9 | Micronized CWS | 40 | 20 | 240 | 250 | 17.6 |
| 1.1 | Micronized CWS | 45 | 10 | 590 | 400 | 33.0 |
| 1.2 | Micronized CWS | 45 | 15 | 590 | 400 | 56.7 |
| 1.3 | Micronized CWS | 45 | 20 | 590 | 400 | 62.2 |
| 2.1 | Conventional CWS | 45 | 10 | 590 | 400 | 29.2 |
| 2.2 | Conventional CWS | 45 | 15 | 590 | 400 | 45.5 |
| 2.3 | Conventional CWS | 45 | 20 | 590 | 400 | 54.5 |
| 2.4 | Conventional CWS | 45 | 10 | 240 | 400 | 25.4 |
| 2.5 | Conventional CWS | 45 | 15 | 240 | 400 | 33.8 |
| 2.6 | Conventional CWS | 45 | 20 | 240 | 400 | 39.5 |
| 2.7 | Conventional CWS | 45 | 10 | 240 | 250 | 5.6 |
| 2.8 | Conventional CWS | 45 | 15 | 240 | 250 | 15.5 |
| 2.9 | Conventional CWS | 45 | 20 | 240 | 250 | 18.1 |
| 2.1 | Conventional CWS | 40 | 10 | 590 | 400 | 18.5 |
| 2.2 | Conventional CWS | 45 | 15 | 590 | 400 | 37.6 |

The development of a super green coal to be used as a coal-in-water slurry according to embodiments of the invention has the potential of massive savings in the applications as described above, and particularly in the low NOx burner applications because less coal is needed to produce the same amount of energy produced in today's applications. Further, the virtually complete burning of the coal reduces the amount of coal present in the waste streams, such as the ash of a boiler.

The invention therefore addresses and resolves many of the deficiencies and drawbacks previously identified. The invention may be embodied in other specific forms without departing from the essential attributes thereof; therefore, the illustrated embodiments should be considered in all respects as illustrative and not restrictive. The claims provided herein are to ensure adequacy of the present application for establishing foreign priority and for no other purpose.

What is claimed is:

1. A colloidal slurry of nano-dispersed coal in water suitable for use as an efficient-burning fuel, the slurry comprising:

a first plurality of coal particles dispersed in water, the first plurality of coal particles comprising about 50 weight percent to about 80 weight percent of the slurry, wherein about 20% to about 80% of the first plurality of coal particles has a particle size in a range of about one micron to about 100 nm with a size mode of about 200 nm to about 300 nm.

2. The coal-water slurry according to claim 1, wherein the first plurality of coal particles comprise about 60 weight percent to about 70 weight percent of the slurry.

3. The coal-water slurry according to claim 1, the slurry further comprising at least one surfactant system selected from the group consisting of a nonionic surfactant, an ionic surfactant, an inorganic salt, an organic salt, and combinations thereof.

4. The coal-water slurry according to claim 3, wherein the at least one surfactant system is present in the slurry in the amount of about 500 to about 3000 parts per million.

5. The coal-water slurry according to claim 1, the slurry further comprising large coal particles having a size of about 150 μm to about 400 μm.

6. The coal-water slurry according to claim 5, wherein a size ratio of the large coal particles to the first plurality of coal particles is greater than 100.

7. The coal-water slurry according to claim 6, wherein the first plurality of coal particles comprise about 58 weight percent to about 62 weight percent of the slurry, and the first plurality of coal particles and the large coal particles combined comprise about 68 weight percent to about 72 weight percent of the slurry.

8. The coal-slurry according to claim 7, wherein the slurry further comprises a volatile component selected from the group consisting of methanol, ethanol, propanol, butanol, glycerol and combinations thereof.

9. The coal-water slurry according to claim 5, wherein a mass fraction of the large particle size coal is about 25% to about 35% of the total coal in the slurry.

10. The coal-water slurry according to claim 5, wherein the large coal particles are suspended in a relevant colloidal fraction of the first plurality of coal particles.

11. The coal-water slurry according to claim 1, wherein the slurry has a viscosity at 120 degrees Fahrenheit in the range of about 350 centipoise to about 1000 centipoise.

12. The coal-water slurry according to claim 1, wherein each of the first plurality of coal particles has a size less than 100 microns.

13. The coal-water slurry according to claim 1, wherein a particle size distribution of the first plurality of coal particles is multi-modal, with a first size mode of about 200 to about 300 nanometers, a second size mode of about 1 to about 2 microns, and a third size mode greater than 4 microns.

14. The coal-water slurry according to claim 1, wherein a particle size distribution of the first plurality of coal particles is bimodal.

15. The coal-water slurry according to claim 1, further comprising a nano-dispersion of an organic liquid or oil.

16. The coal-water slurry according to claim 1, further comprising at least one alternative fuel source selected from the group consisting of biomass, petroleum coke, and combinations thereof.

17. The use of the coal-water slurry according to claim 1 as the efficient-burning liquid fuel in an application selected from the group consisting of a low NOx burner, a gasification process, a gas turbine, a diesel engine, and a Rankine cycle.

18. The coal-water slurry according to claim 1, wherein the coal particles are selected from the group consisting of lignite, sub-bituminous, bituminous, anthracite, and combinations thereof.

19. A slurry of coal-in-water comprising:

large coal particles having a size of about 150 microns to about 400 microns suspended in a colloidal fraction of a nano-dispersion of coal in water, the nano-dispersion of coal in water having coal particles including nano-sized coal particles, wherein between about 30% to about 50% of the coal particles have a size of about 4 microns or less, and at least 20% of the nano-sized coal particles have a size less than 1 micron with a mode size of about 200 nm to about 300 nm.

20. The coal-water slurry according to claim 19, further comprising at least one surfactant system selected from the group consisting of a nonionic surfactant, an ionic surfactant, an inorganic salt, an organic salt, and combinations thereof.

* * * * *